US006502447B2

(12) United States Patent
Adams et al.

(10) Patent No.: US 6,502,447 B2
(45) Date of Patent: Jan. 7, 2003

(54) DEVICE AND METHOD FOR MANUFACTURING TURBULATORS FOR USE IN COMPACT HEAT EXCHANGERS

(75) Inventors: Kenneth L. Adams, Lockport; Michael E. Harmer, Medina; Robert L. Carlo, Ransomville, all of NY (US)

(73) Assignee: Voss Manufacturing, Inc., Sanborn, NY (US)

( * ) Notice: Subject to any disclaimer, the term of this patent is extended or adjusted under 35 U.S.C. 154(b) by 0 days.

(21) Appl. No.: 09/736,966

(22) Filed: Dec. 14, 2000

(65) Prior Publication Data

US 2001/0029767 A1 Oct. 18, 2001

Related U.S. Application Data

(60) Provisional application No. 60/170,602, filed on Dec. 14, 1999.

(51) Int. Cl.[7] ..... B21D 53/04

(52) U.S. Cl. ..... 72/326; 72/379.6; 72/385; 72/414

(58) Field of Search ..... 72/414, 412, 325, 72/326, 389.2, 389.3, 385, 379.6, 177; 29/890.049

(56) References Cited

U.S. PATENT DOCUMENTS

| | | | | | |
|---|---|---|---|---|---|
| 1,056,871 | A | * | 3/1913 | White | |
| 1,714,214 | A | * | 5/1929 | Darling | |
| 2,163,063 | A | * | 6/1939 | Romanoff | |
| 2,289,150 | A | * | 7/1942 | Tangerman | |
| 3,119,432 | A | * | 1/1964 | Rogers | |
| 3,266,281 | A | * | 8/1966 | Fust | |
| 3,734,135 | A | | 5/1973 | Mosier | 138/38 |
| 3,748,889 | A | * | 7/1973 | Miller | 72/385 |
| 3,768,149 | A | | 10/1973 | Swaney, Jr. | 29/527.2 |
| 4,170,122 | A | | 10/1979 | Cowell | 72/186 |
| 4,282,927 | A | | 8/1981 | Simmons | 165/166 |
| 4,502,315 | A | * | 3/1985 | Dubrovsky | 72/385 |
| 4,736,610 | A | * | 4/1988 | Carroll | 72/325 |
| 4,805,693 | A | | 2/1989 | Flessate | 165/153 |
| 5,107,922 | A | | 4/1992 | So | 165/109.1 |
| 5,185,925 | A | | 2/1993 | Ryan et al. | 29/890.049 |
| 5,209,289 | A | | 5/1993 | Haushalter | 165/109.1 |
| 5,738,169 | A | | 4/1998 | Stoynoff | 165/152 |
| 5,794,691 | A | | 8/1998 | Evans et al. | 165/153 |
| RE35,890 | E | | 9/1998 | So | 165/109.1 |

FOREIGN PATENT DOCUMENTS

| | | | | |
|---|---|---|---|---|
| DE | 601234 | * | 8/1934 | 72/385 |
| FR | 96620 | * | 9/1872 | 72/385 |
| FR | 889094 | * | 12/1943 | 72/414 |
| FR | 937440 | * | 8/1948 | 72/389 |
| JP | 38-7211 | * | 5/1963 | 72/385 |

* cited by examiner

*Primary Examiner*—Daniel C. Crane
(74) *Attorney, Agent, or Firm*—Hodgson Russ LLP

(57) ABSTRACT

A progressive die for forming a turbulator having multiple rows of axial corrugations. The corrugations are slit and offset such that artificial turbulence is generated as it passes through the corrugations. The device includes a plurality of dies disposed along an axial material direction. A flat strip of material enters the dies and is folded about its longitudinal axis in a relatively wide V-fold. As the strip of material moves forward, it is intermittently stamped in the series of dies. The initial dies create a central V-shaped fold that gradually narrows into a U-shaped channel with straight walls. Once the first corrugation is formed, a series of progressive dies form the remaining corrugations in alternating fashion. Next, the material moves through a slitting station that provides apertures and an axial offset such that adjacent sections of the corrugation are slit and offset in the axial direction.

19 Claims, 13 Drawing Sheets

DEVICE AND METHOD FOR MANUFACTURING TURBULATORS FOR USE IN COMPACT HEAT EXCHANGERS

CROSS-REFERENCE TO RELATED APPLICATION

Applicant hereby claims priority based on U.S. Provisional Patent Application No. 60/170,602 filed Dec. 14, 1999, and entitled "Device and Method for Manufacturing Turbulators for Use in Compact Heat Exchangers," which is incorporated herein by reference.

FIELD OF INVENTION

The present invention relates to turbulators used in compact tube heat exchangers for use in automotive applications.

BACKGROUND OF THE INVENTION

It has been known to use thin metal sheet or foil which has been formed into corrugations in heat exchangers and to form such material with louvers to improve the heat exchange characteristics of the material. It has also been known to form corrugated material with alternate staggered portions so that the free edges of the portions are presented to the flow of fluid over the material when used in heat exchangers. An example of such material is disclosed in U.S. Pat. No. Re. 35,890 issued to So.

The thin metal sheets that are intended to generate artificial turbulence are generally referred to as turbulators or turbulizers and typically consist of sinusoidal convolutions or rectangular corrugations extending in rows axially along the length of a heat exchanger. Adjacent rows in the flow or axial direction are displaced from one another thereby creating transverse rows of transversely aligned parallel slits or apertures. The function of this geometry is to create artificial turbulence since as the hot fluid flows through the heat exchanger and impinges against the leading edge of the corrugations, the resulting excessive form drag splits the fluid flow sideways as it advances to the next row of corrugations. This artificial turbulence is desirable in that it results in enhanced heat transfer characteristics.

Current design trends in the automotive industry are towards more compact and aerodynamically efficient designs in an effort to increase fuel efficiency and accommodate new accessories such as pollution control devices and the like. These trends have led to a need to reduce the size of the radiator tank, and therefore more compact oil coolers are required. Accordingly, there is a need for smaller turbulators having widths substantially smaller than their lengths.

It has been known to produce corrugated material from sheets of raw material by rolling the material through a pair of cooperating rollers forming a nip and having surface enhancements and knives for forming the corrugations and for making the slits. An example of a roller system for producing corrugated sheet material is disclosed in U.S. Pat. No. 4,170,122 issued to Crowell. Some of the drawbacks to the rolling process include the cost of the rolls due to the surface enhancements for rolling the corrugations and the required width of the rolls. In rolling techniques the material is typically fed in a direction perpendicular to the longitudinal axes of the corrugations thereby requiring a wide roll for longer parts. The wide rollers require expensive tooling and larger machines. Also, once the corrugations are formed they have to be cut into strips at the desired width, and the cutting of the individual pieces has to be coordinated with the motion of the rollers. As a result, the accuracy of the rolls with regard to the height of the corrugations is somewhat limited.

As an alternative to rolling, a stamping process is desirable in that it reduces the cost of the machine, enables the part to be formed in the longitudinal direction corresponding to the longitudinal axes of the corrugations, and provides greater accuracy with regard to the shape of the corrugations and particularly the height. One of the problems with stamping thin sheets of aluminum is that the material is relatively brittle and the stamping process can result in failures such as cracking that may present themselves during the formation of the corrugations or during the slitting of the turbulator. It has been determined that in forming a multi-corrugated turbulator, the first corrugation is the most critical, and if the process of forming the first corrugation creates too much stress, the part will fail. The typical method for forming the initial corrugation is pressing the flat sheet of raw material in a die set between a solid punch and a die. The punch is a relatively sharp tool that even when rounded at the end may cause too much stress that results in cracking down the middle of the raw material in the axial direction.

Accordingly, what is needed is a device and method for forming relatively small, narrow turbulators in a stamping process without cracking and/or other stress related failures.

SUMMARY OF THE INVENTION

The present invention meets the above described need by providing a device and method for manufacturing a turbulator.

The present invention provides for manufacturing compact turbulators having lengths substantially larger than their widths and that are typically made of thin gauge metals.

The device provides a progressive die for use in a high-speed press for forming a turbulator having multiple rows of axial corrugations. The corrugations are slit and offset such that artificial turbulence is generated as the fluid passes through the corrugations. The device includes a plurality of progressive dies disposed along an axial material direction.

A flat strip of material enters the dies and is folded about its longitudinal axis in a relatively wide V-fold. As the strip of material moves forward, it is intermittently stamped in the series of dies. The initial dies create a central V-shaped fold that gradually narrows into a U-shaped channel with approximately straight walls.

Once the first corrugation is formed, a series of progressive dies form the remaining corrugations in alternating fashion. Next, the material moves through a slitting station that provides the turbulator with apertures and an axial offset in the axial direction.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

The present invention now will be described more fully hereinafter with reference to the accompanying drawings, in which embodiments of the invention are shown. This invention may however be embodied in many different forms and should not be construed as limited to the embodiments set forth herein; rather, these embodiments are provided so that this disclosure will be thorough and complete, and will fully convey the scope of the invention to those skilled in the art.

Figure 1A:
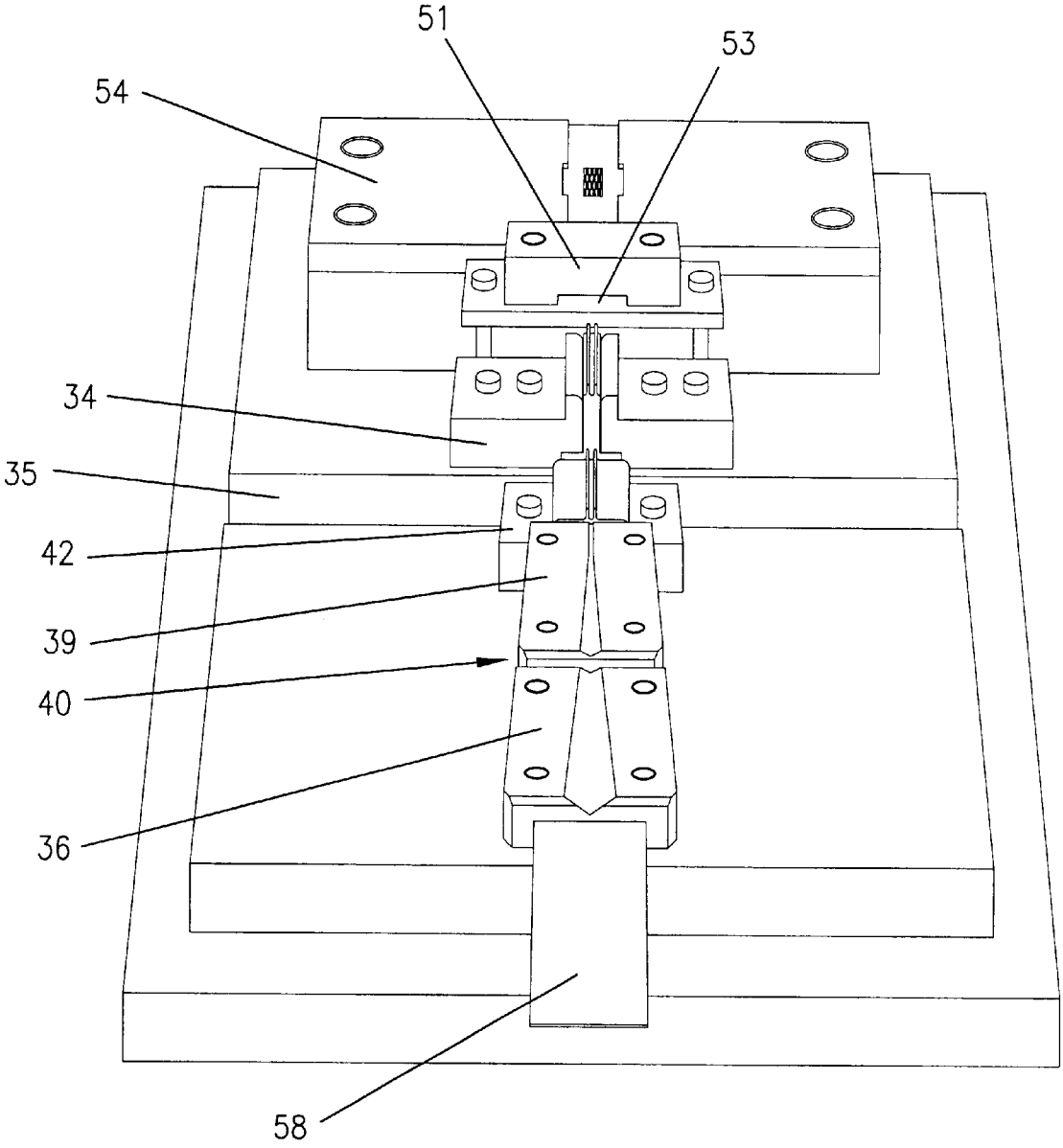
FIG. 1A is a schematic diagram of a progressive die.

In FIG. 1A, an example of the progressive die of the present invention includes a series of lower dies disposed along a direction that generally corresponds to the longitudinal axis and direction of travel of the unfinished material. The dies are preferably formed by an EDM machining process from hardened materials suitable for use as tooling. The lower dies combine with the upper dies and punches shown in FIGS. 15–19 to form die sets. The lower dies are mounted on riser blocks 34 that are attached to a plate 35. A first preform die 36 and a second preform die 39 are located on the press 30 at the upstream end. The first and second preform dies 36, 39 have a space between them capable of receiving a stripper to lift the material out of the die between stamping cycles. In some applications, the preform may also comprise a single longer preform die substituted for the first and second preform dies 36, 39. A third die 42 forms a pair of corrugations that are disposed in the opposite direction from the corrugation formed in the second preform die 39 and that extend along the longitudinal direction of the material. A fourth die 45 and a fifth die (not shown) are disposed on opposite sides of a spring loaded stripper 51. The gaps between the third and fourth and fourth and fifth dies are approximately equal and allow the work material to flow during the stamping process and to relax between successive dies.

The stripper 51 has a central opening 53 that receives the strip of material there through. The stripper is spring biased such that it lifts the material off of the die when the press opens. Additional strippers can be provided between the third and fourth dies and also in front of the first preform die 36. The stripper removes the material from the dies so that it can move forward without jamming.

Finally, a slitting station 54 includes a set of sharp punches or knives for cutting apertures or louvers into the corrugations. The slitting die set includes an upper and lower set of punches. The lower punches extend through openings in a flat plate during the stamping cycle and are retracted inside the openings when the material is being indexed. The flat plate is disposed between a pair of blocks that provide edge guidance for the strip of material as it passes through the progressive die 30.

A strip 57 of flat sheet material is preferably mechanically fed into the upstream end of the progressive die from a feeder 58 which may comprise a roll feeder or a set of pneumatically operating gripping feeders as known to those of ordinary skill in the art. The sheet material is typically in the range of 0.010 inches thick and may consist of various metals or metal-like materials capable of being stamped such as steel, brass, aluminum, and the like. The strip of incoming material is provided with edge guidance by the stripper 51 and the slitting station 54 and with positive traction such that it is pushed through the machine. The machine operates by pushing the strip of flat material forward, pressing the punches and dies together, opening the punches and dies and then moving the strip 57 forward again after each cycle. The stamping operation generally operates in the range of 80–300 stamping cycles per minute. Between each stamping, the material indexes forward a uniform distance, and this distance varies depending on the size of the machine.

The strip 57 is initially folded about its longitudinal axis to form a V-shape. As the material travels downstream, it is repeatedly stamped in the dies.

Figure 1B:
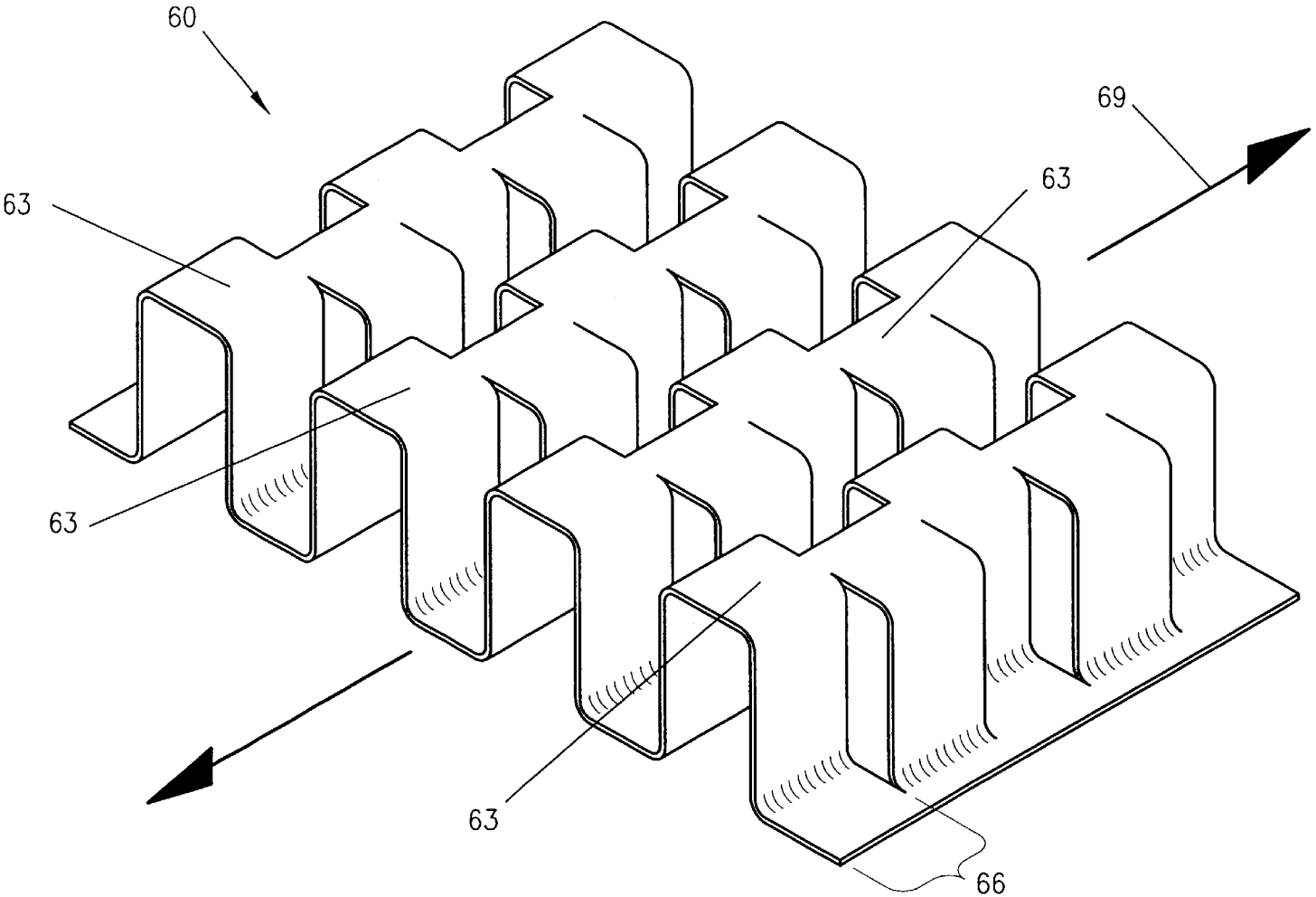
FIG. 1B is a perspective view of a turbulator.

In FIG. 1B, a turbulator 60 produced by the device and method of the present invention is shown. The turbulator 60 shown is approximately one-half inch wide and has four corrugations 63 oriented along the axial direction. Other dimensions and numbers of corrugations may also be formed by the device and method of the present invention depending on the heat transfer and other considerations of the final application. The corrugations 63 are slit and divided into adjacent sections 66 and the adjacent sections 66 are offset from one another transverse to the axial direction 69 such that disruption of the fluid flow through the heat exchanger occurs. As an example only, the raw material is a one inch flat strip of 0.010 inch thick aluminum. Other thin gauge metals or metal-like materials would also be suitable.

After the material leaves the first preform die 36, it indexes forward into the second preform die 39 where it continues to neck down until it is gradually transformed from the wider V-shaped fold into the shape of the initial rib. By the time that the material exits the second preform die, the material has begun to assume the shape of the first rib.

Figure 17:
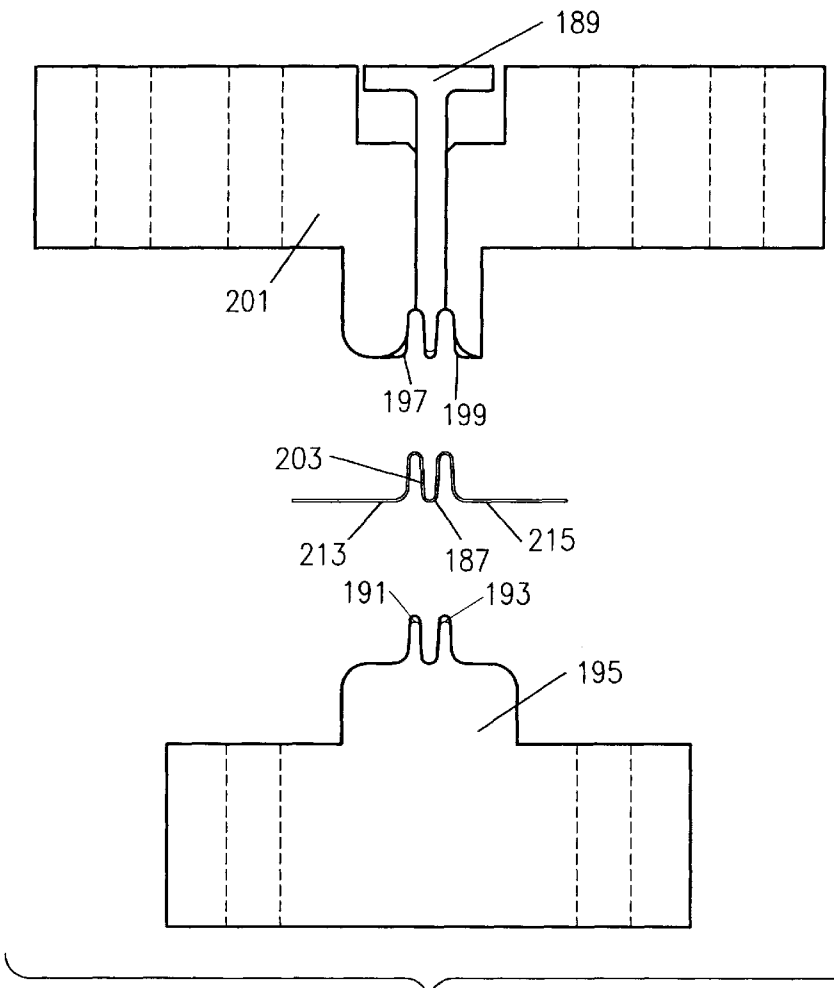
FIG. 17 is a front elevational view of the punch and die for forming two corrugations.

The third die 42 is a U-shaped channel with straight walls for stamping a pair of corrugations disposed in a direction opposite the direction of the initial corrugation formed in the second die 36 (best shown in FIG. 17). After passing through the first preform dies, the material continues downstream and is acted upon by a series of punches and dies that form additional corrugations 63 and then finally the strip of material 57 passes through the slitting die 54 that cuts the corrugations and provides the alternating offsetting portions. Downstream of the preform a spring-loaded stripper 51 is positioned such that after the press is opened the material is lifted off of the dies such that it can be indexed forward without jamming.

Figure 2:
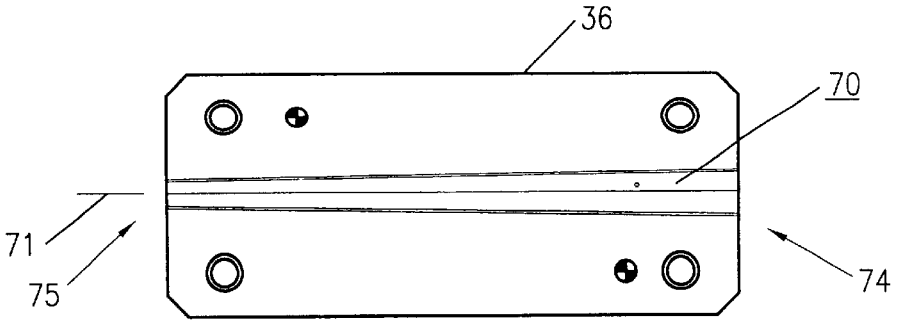
FIG. 2 is a top plan view of a first preform die of the present invention.
Figure 3:
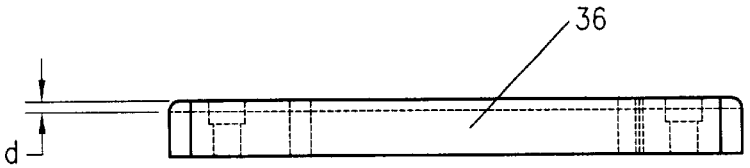
FIG. 3 is a side elevation of the first preform die of the present invention.
Figure 4:
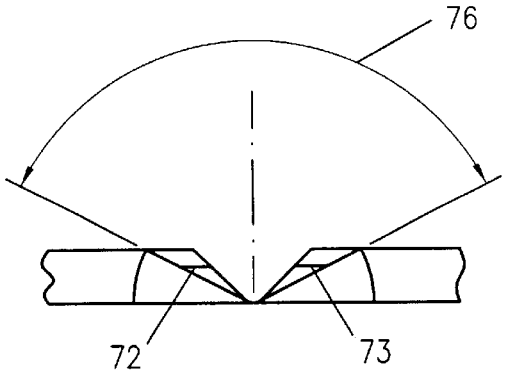
FIG. 4 is an end view of the die of FIG. 3 illustrating the angle at the entrance end.
Figure 5:
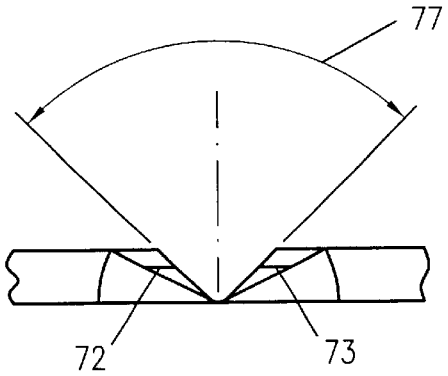
FIG. 5 is an end view of the die of FIG. 3 illustrating the angle at the exit end.

In FIG. 2, a first embodiment of the first preform die 36 is shown. The die 36 has a longitudinal slot 70 extending along a longitudinal axis 71. The longitudinal slot 70 is formed from a pair of opposed walls 72, 73 (FIGS. 4–5). As shown the slot 70 is wider at a first end 74 than at the opposite end 75. The die 36 is about six inches long by two and one-half inches wide. As shown in FIG. 3, the slot 70 may be provided with a uniform depth d. In FIG. 4, the angle 76 between the opposed walls 72, 73 is illustrated for the first end 74 of the die. The angle 76 may vary between about 110 and 140 degrees. In the example shown, the angle 76 is 126 degrees. In FIG. 5, the angle 77 between the opposed walls 72, 73 is shown at the second end of the die 36. The angle 77 may vary between about 80 and 100 degrees. In the example shown, the angle 77 is 91 degrees. The angle between the opposed walls varies gradually between the first end 74 and the second end 75.

Figure 6:
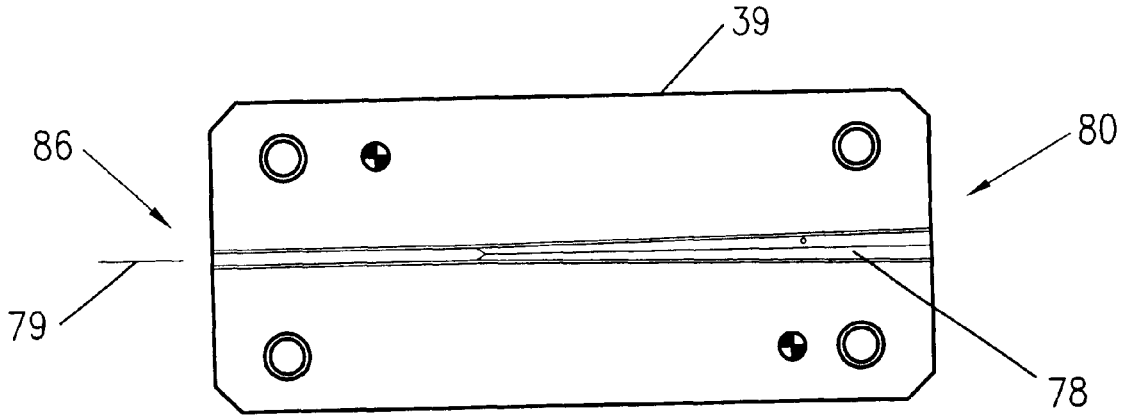
FIG. 6 is a top plan view of the second preform die.
Figure 7:
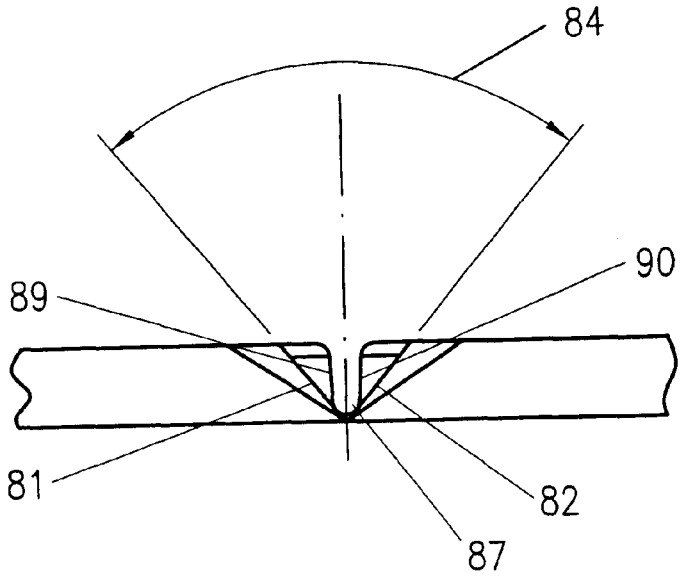
FIG. 7 is an end view of the second preform die.
Figure 16:
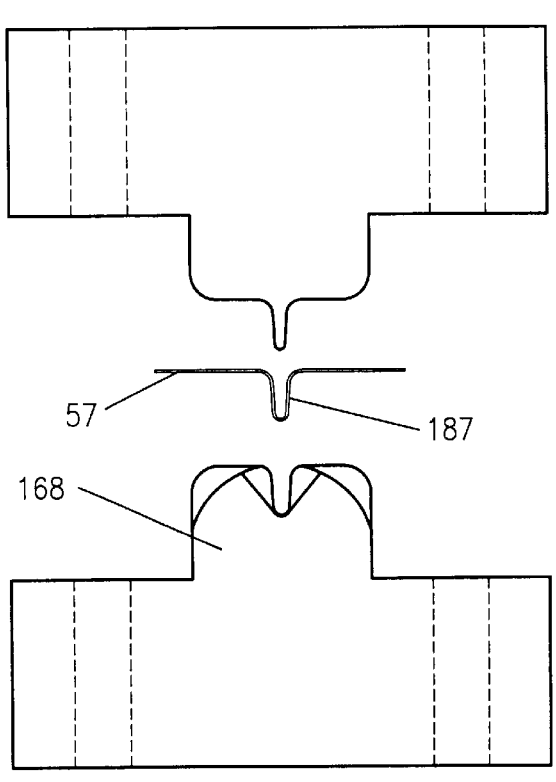
FIG. 16 is a front elevational view of the second preform die, the work, and the punch.

In FIGS. 6–7, the second preform die 39 is shown. The second preform die is six inches long by 2.5 inches wide. The second preform die 39 has a longitudinal slot 78 that extends along a longitudinal axis 79. The longitudinal slot 78 is formed at a first end 80 by a pair of opposed walls 81 and 82 (FIG. 7). The angle 84 between the opposed walls 81, 82 at the first end 80 is about 70 to 90 degrees. In the embodiment shown, the angle is about 81 degrees. At a second end 86 opposite the first end 80, the slot 78 is U-shaped with a rounded bottom 87 and a pair of substantially parallel side walls 89 and 90. This shape at the second end 86 corresponds to the shape of the first rib 187 (FIG. 16).

Figure 8:
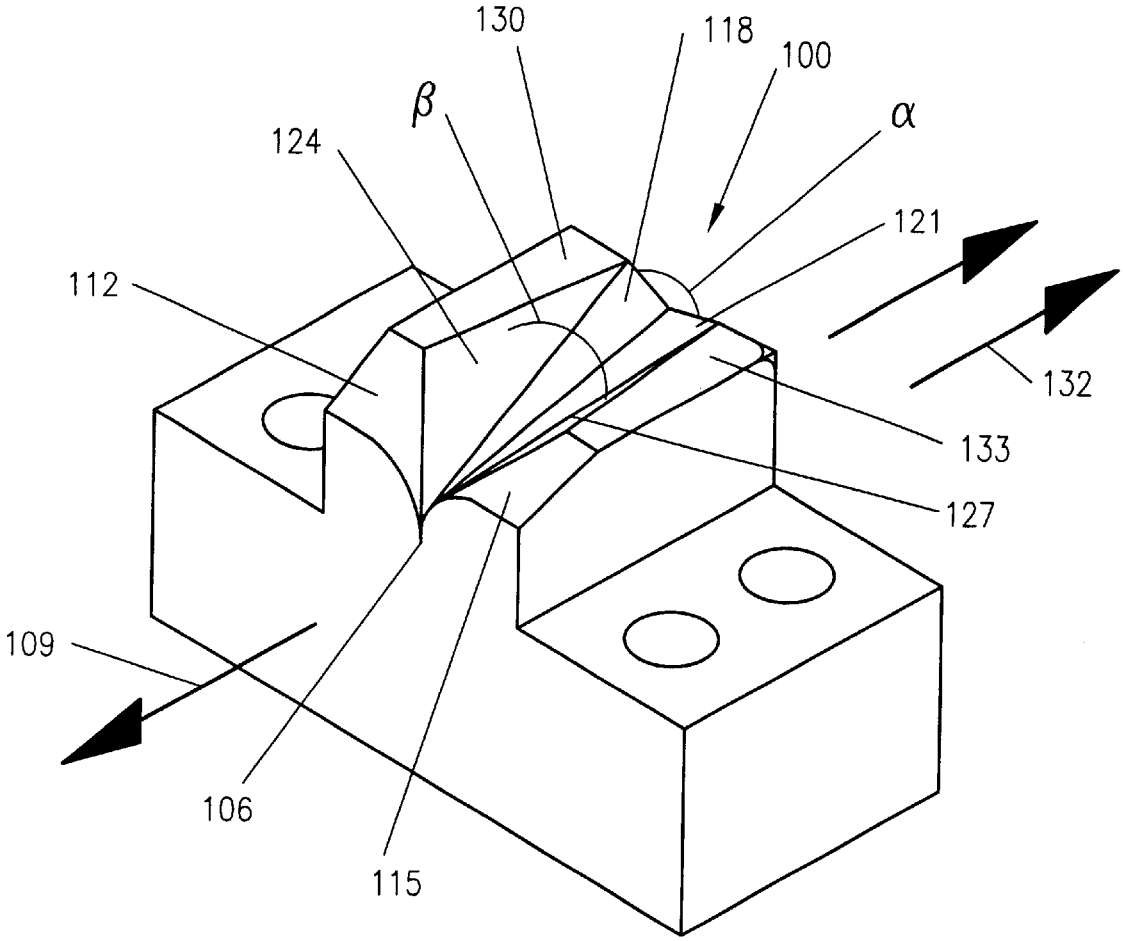
FIG. 8 is a perspective view of an alternate embodiment of the first preform die.

Turning to FIG. 8, a second embodiment of the first preform die 36 is shown. The die 100 shown in FIG. 8 is formed of a complex geometrical shape. The die 100 preferably contains blend radii where every surface shown in FIG. 8 meets. The first preform die 100 acts in combination with an overhead punch 103 (shown in FIG. 15), to bend the aluminum strip into a wide, relatively flat V-shaped configuration.

The junction 106 of the two legs of the V-shape is slightly rounded by a central radius. The V-shape of the first preform die 100 starts wider and flatter at the inlet and gradually the V-shape becomes narrower at the outlet.

The first preform die 100 is substantially symmetrical and is disposed along a central longitudinal axis 109 that corresponds with the longitudinal axis of the raw material. The surfaces 112 and 115 of the die 100 slope upward at the opposite sides of the inlet. A pair of opposed triangular planar faces 118, 121 are disposed on opposite sides of the central axis 109. The opposed triangular faces form the V-shape at the outlet of the first preform die 100 and the two faces form an angle $\alpha$ between them. A pair of four-sided (trapezium) faces 124, 127 are adjacent to the triangular faces 118, 121. The four-sided faces intersect with an edge of the triangles and the transition is blend radiused. The opposed four-sided faces form an angle $\beta$ between them that is larger than the angle $\alpha$.

Each of the triangular 118, 121 and four-sided faces 124, 127 have a side disposed along the central axis 109. The pair of opposed, curved faces 112, 115 are disposed on opposite sides of the central axis 109 at the inlet.

The four-sided faces have blend radii that provide a curved transition to the top surfaces 130, 133 and to the curved surfaces 112, 115. The four-sided face is wider toward the inlet and therefore provides for a wider flatter V-shape for the material toward the inlet.

The inner faces create a V-shaped channel with rounded edges. The inner faces are angled such that the channel is wider at the inlet and narrower at the outlet. The curved faces 112, 115 curvedly transition to the four-sided face and to the top surfaces 130, 133.

In operation, the material travels in the direction of arrow 132 across the top of the first preform 100 and lies substantially flat with respect to the top surfaces 130, 133. When the press closes, a punch 103 (best shown in FIG. 15) comes down and engages with the first preform die 100. As a result, the strip 57 is bent approximately at its midpoint and along its longitudinal axis into a V-shape. Typically, a section of material is stamped at least three times before it leaves the first preform die 100. While the press is stamping the material, the strip 57 does not move. Once the press is opened and the punch 103 and die 100 are separated, the strip 57 moves forward at a predetermined increment.

The purpose of the first preform die is to gradually fold the strip into a V-shaped longitudinal fold. The first preform die 36 is preferably radiused at the junction 106 of the two sides of the V-shape.

Figure 11:
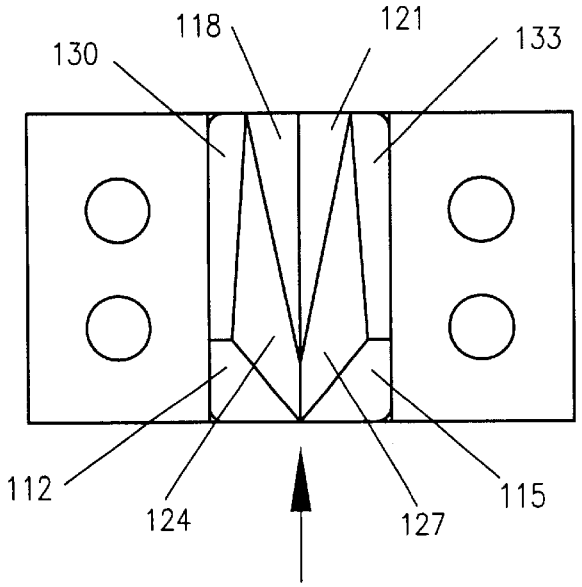
FIG. 11 is a top plan view of the preform die of FIG. 8.

Turning to FIG. 11, the triangular faces 118, 121, and four-sided faces 124, 127 are shown in a plan view. As shown, the sides 136, 139 of the four-sided faces angle inward such that the sides of the V-shape start relatively wide and then neck down as the material passes through the die. Again each of the surfaces preferably have blend radii to make a curved transition to the other surfaces. Also, the surfaces themselves may be provided with a slight curvature.

Figure 9:
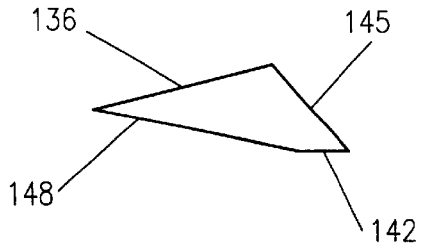
FIG. 9 is a detail view of one of the inner faces on the preform die of FIG. 8.
Figure 10:
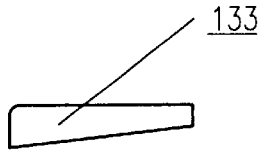
FIG. 10 is a detail view of the top surface of the preform die of FIG. 8.
Figure 12:
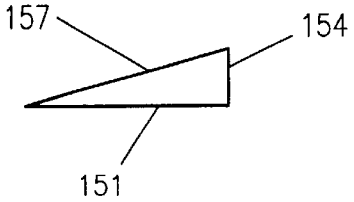
FIG. 12 is a detail view of one of the inner faces on the preform die of FIG. 8.

FIG. 9 is a detailed view of the four-sided surfaces on the first preform die. Side 142 extends for a short distance along the central longitudinal axis of the die. Side 145 extends from the front of the die upward to the top surface and borders the curved surface 112 on the front. Side 136 extends along the top surface at an angle such that the V-shape necks down. The remaining diagonal line 148 borders the triangular shaped face. FIG. 10 shows the top surface 133 of the first preform die. In FIG. 12, the triangular face is shown. Side 151 is parallel to and coincides with the longitudinal axis. Side 154 is substantially perpendicular to the longitudinal axis of the die. The remaining side 157 coincides with one of the sides of the four-sided face.

Figure 13:
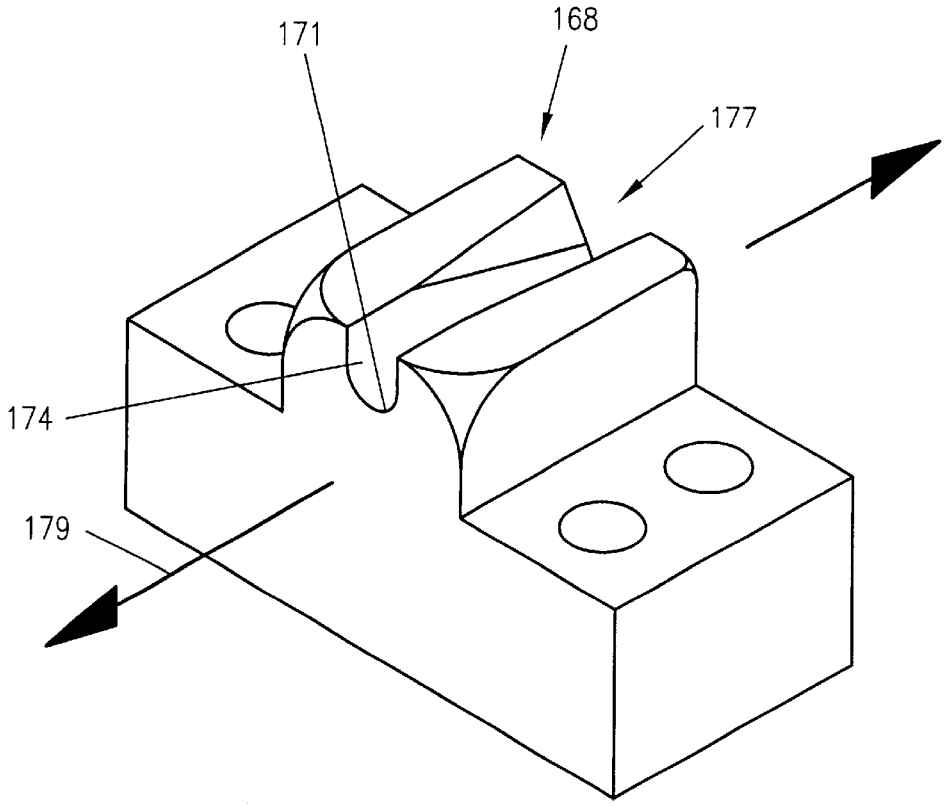
FIG. 13 is a perspective view of the exit end of an alternate embodiment of the second preform die.
Figure 14:
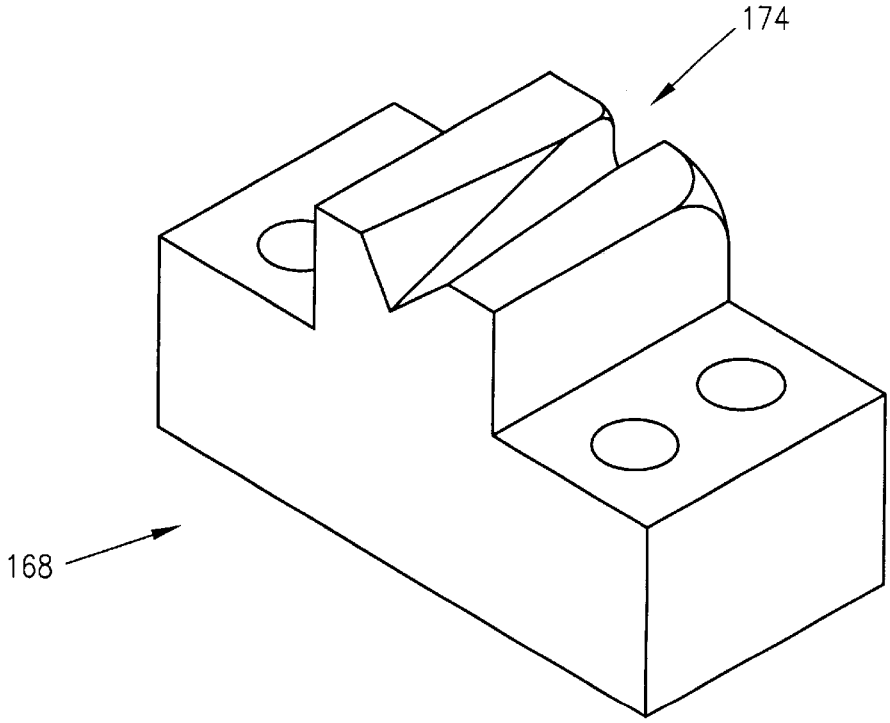
FIG. 14 is a perspective view of the die of FIG. 13 taken from the entrance end.

Turning to FIG. 13, the second preform die 168 has a U-shaped opening 171 at the downstream end. The upstream end is substantially V-shaped as shown in FIG. 14 and approximately corresponds to the V-shaped outlet of the first preform die 100. Accordingly, the first two preform dies 100 and 168 could be replaced with a single longer die. The channel is V-shaped and wider at the inlet and it gradually necks down into a straight walled U-shaped channel 174 at the opposite end (shown in FIG. 13). Referring to FIGS. 13 and 14, the second preform die 168 preferably has a complex geometric shape. Again every edge where two surfaces meet is preferably provided with a blend radius. The central channel 177 is symmetrical about a longitudinal centerline axis 179. The channel starts with a relatively wide V-shaped form.

The straight-walled, U-shaped portion of the channel 177 defines the first corrugation or first rib in the turbulator.

Figure 15:
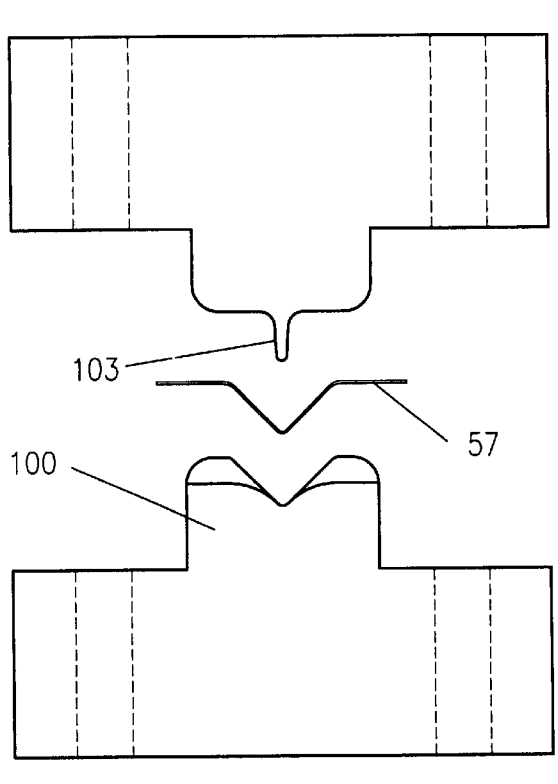
FIG. 15 is a front elevational view of the first preform die, the work, and the punch.

Turning to FIG. 15, in operation a strip 57 of aluminum is stamped between the first preform die 100 and an overhead punch 103. The strip 57 of aluminum is bent downward into the die by the punch. The strip 57 is typically stamped three times before it clears the first preform die 100. As shown, the first preform die 100 causes a bending of the strip 57 about the longitudinal axis. The resulting form is substantially V-shaped in the center and flat on opposite sides of the V-shaped central portion.

In FIG. 16, the strip of material 57 is shown in cross-section as it exits the second preform die 168. As shown, the strip of material 57 enters the second preform die 168 in a relatively wide V-shape. As the strip of material 57 moves down the die 168, the sides of the V are brought closer together and the bottom is curved into a U-shape. The punch and die typically close and open at least three times before the material exits each preform die. Accordingly, the stamping process has at least three stamping strokes to form the strip 57 as shown.

Turning to FIG. 17, once the central rib 187 is formed by the first two dies the additional folds necessary to form a turbulator 60 are caused by the cooperation of the punches and the dies. The sliding punch 189 pushes the central corrugation down in between the two raised portions 191, 193 on the die 195. With the punch 189 holding the corrugation 63 in position, the edges 197, 199 of the upper head 201 bend the strip 57 about the projections 191, 193 on the die. The punch 189 holds the first corrugation in place and prevents the material for the fold from being drawn from the sides 203 of the first corrugation 63. Accordingly, the material for the fold comes from the flat portions on opposite sides of the corrugation 63. In this manner, thinning of the corrugation 63 is prevented. If the punch 189 did not move down to hold the first corrugation 63, the thinning of the first corrugation 63 could lead to failures.

Figure 18:
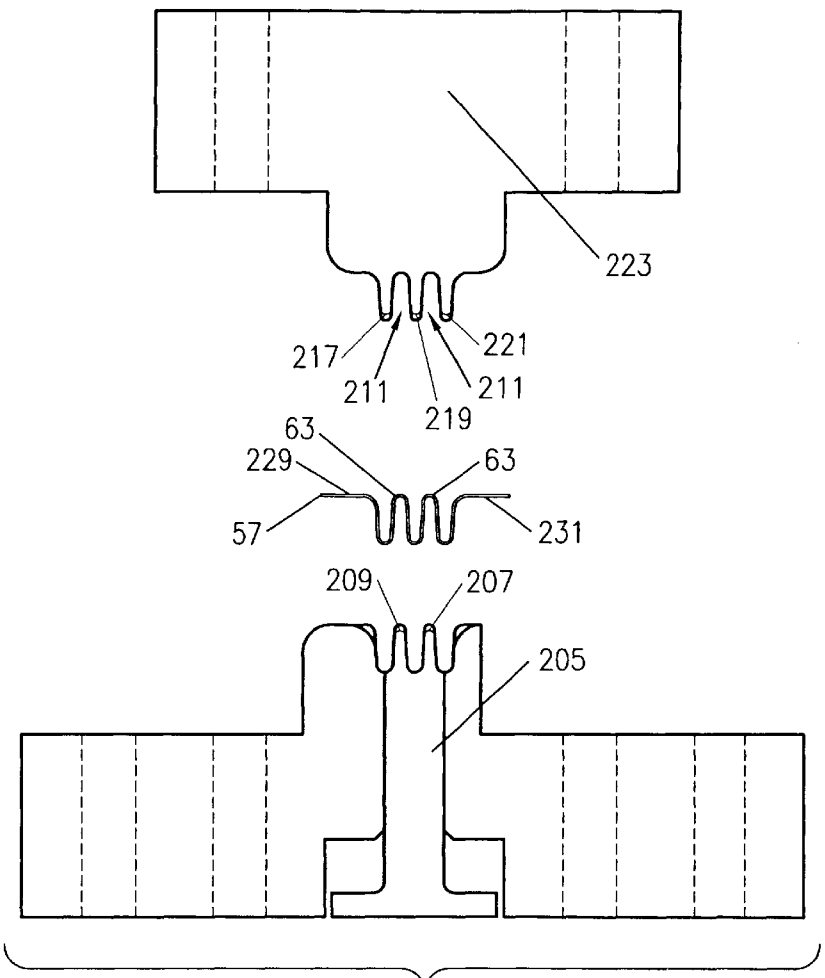
FIG. 18 is a front elevational view of the punch and die for forming three corrugations.

In FIG. 18, the punch 205 has two protrusions 207, 209 that push the two corrugations 63 formed in FIG. 17 into the openings 211 in the die. Next, the flat portions 213, 215 adjacent the corrugations 63 (shown in FIG. 16) are bent around the projections 217, 219, 221 on the die 223. As a result, the strip 57 takes the cross-sectional form, shown in FIG. 18.

Figure 19:
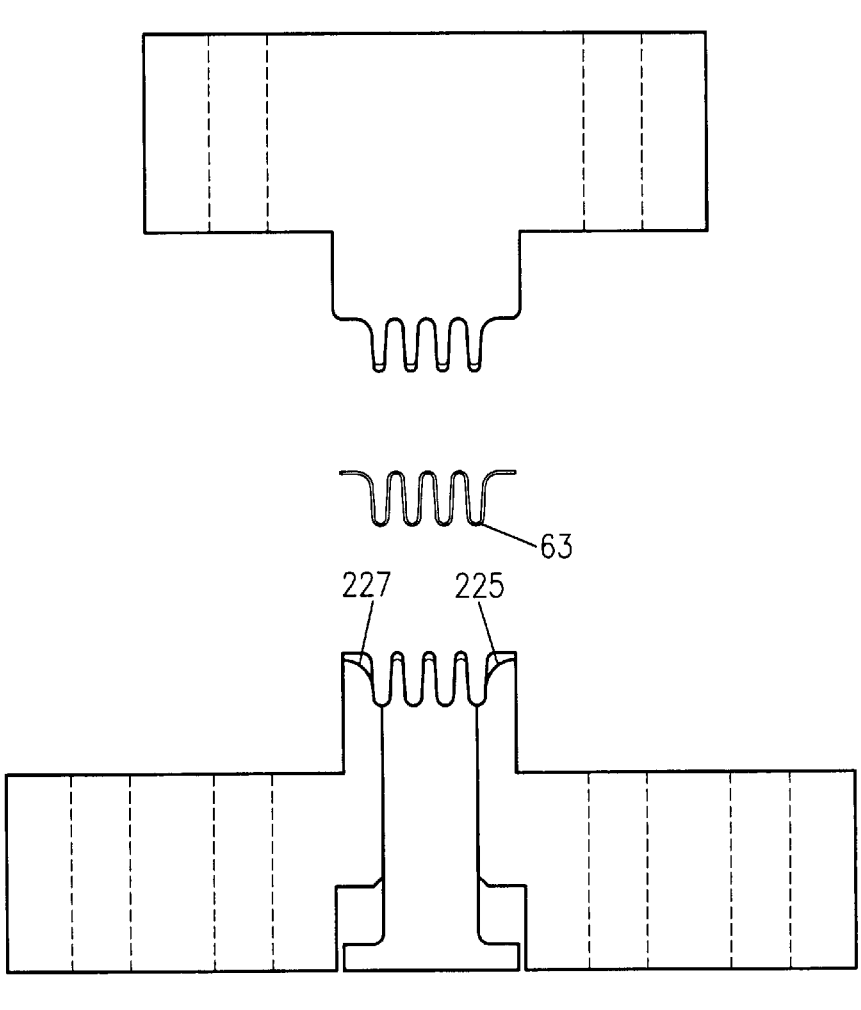
FIG. 19 is the punch and die for forming four corrugations.

As shown in FIG. 19, the corrugations 63 are gradually formed by larger punches and dies. The upper head has a pair of curved edges 225, 227 that bend the flat sections 229, 231 shown in FIG. 18 about the radiused projections shown in FIG. 19. Once the strip 57 exits the dies, it has four rows of corrugations 63. Next, the rows are cut and offset in the slitting station 54 in the manner known to those of ordinary skill in the art.

Figure 20:
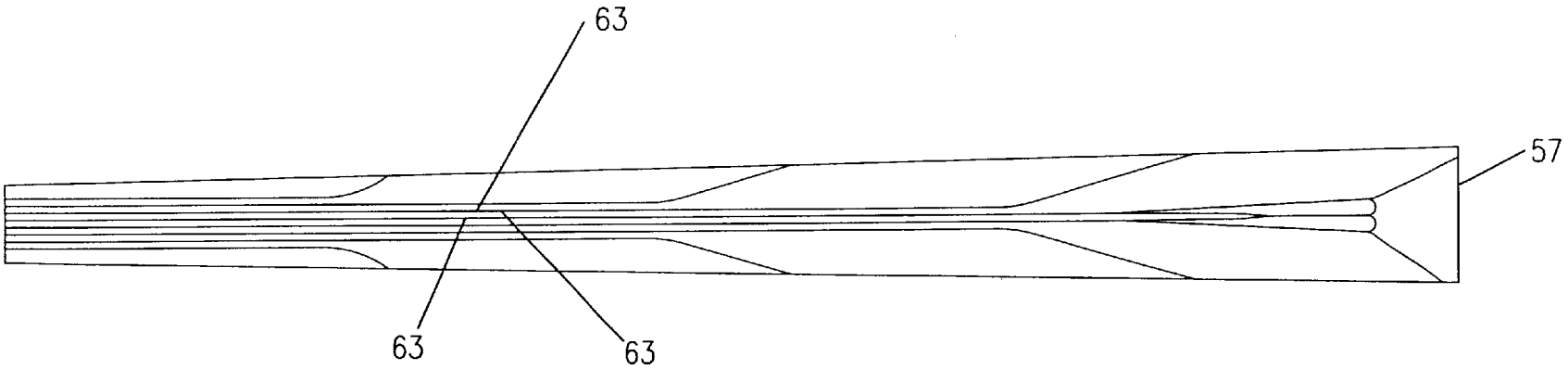
FIG. 20 is a top plan view of the work.

In FIG. 20, the strip of material 57 is shown as it progresses through the series of dies. The first two preform dies 100, 168 first make a central V-fold and then gradually reduce the fold to an approximately straight-walled U-shaped channel forming a typical corrugation 63. Once the first rib 187 is formed, the successive corrugations are formed by the progressive dies.

Finally, the strip of material with parallel rows of corrugations passes through the slitting station 54 which cuts the corrugations and displaces adjacent sections of the corrugations such that adjacent sections are taken out of axial alignment.

Figure 21:
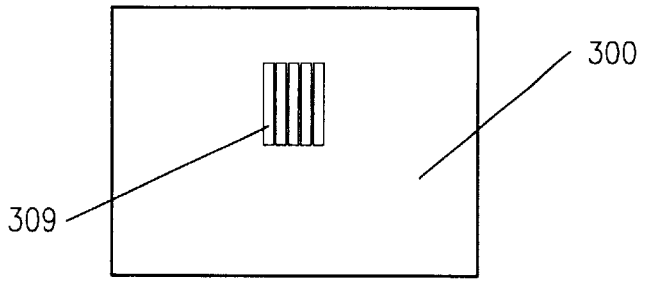
FIG. 21 is a plan view of the stripper plate of the slitting station.
Figure 22:
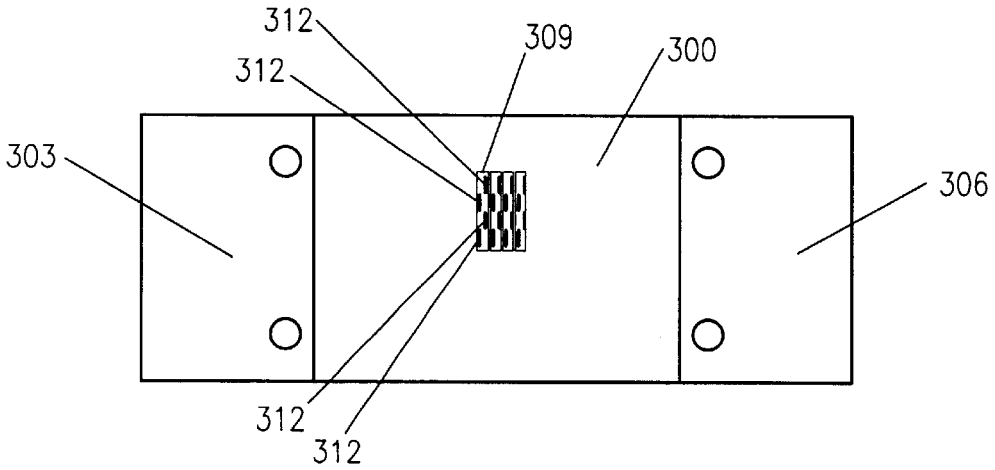
FIG. 22 is a plan view of the lower punches disposed through the lower plate of FIG. 21.
Figure 23:
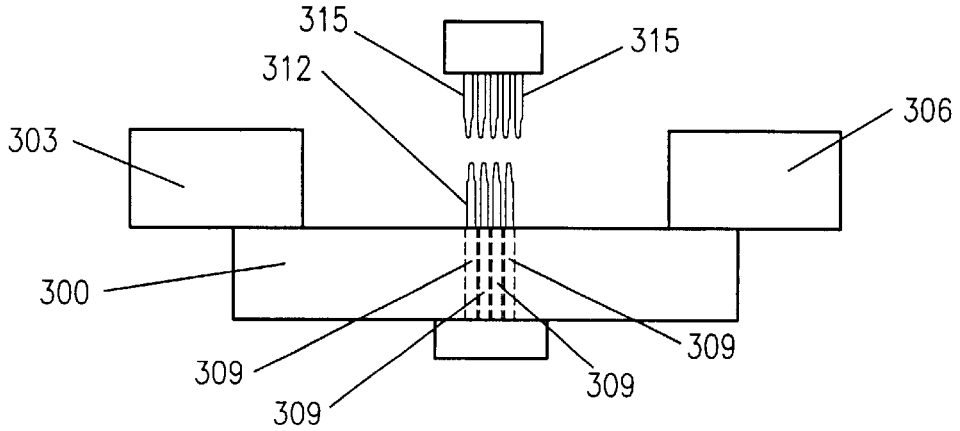
FIG. 23 is a side elevational view of the slitting die set with the lower punch disposed through the openings in the lower plate.

Turning to FIGS. 21–23, the slitting station 54 includes a flat stripper plate 300 having a pair of blocks 303 and 306 disposed on opposite sides of the plate 300. The blocks 303 and 306 provide edge guidance to the strip of material as it travels through the progressive die 30. The plate 300 has a plurality of apertures 309 disposed therein. The apertures 309 receive the punches 312 on the lower die set there through. When the material is being advanced the lower punches 312 retract through the openings 309 below the surface of the plate 300 such that the movement of the strip of material 57 is not obstructed. Once the material is in position for the next stamping cycle, the punches move upward through the apertures 309 as shown in FIG. 22. The lower and upper punches 312, 315 cooperate to create the slit and the offset in the corrugations along the longitudinal axis. The punches push alternate sections of the corrugations toward the middle which creates shear forces inside the material and the cooperation of the upper and lower punches causes the shearing and pushing forward of the adjacent sections of the corrugations which results in the slit and the offset shown in FIG. 1B.

Figure 24:
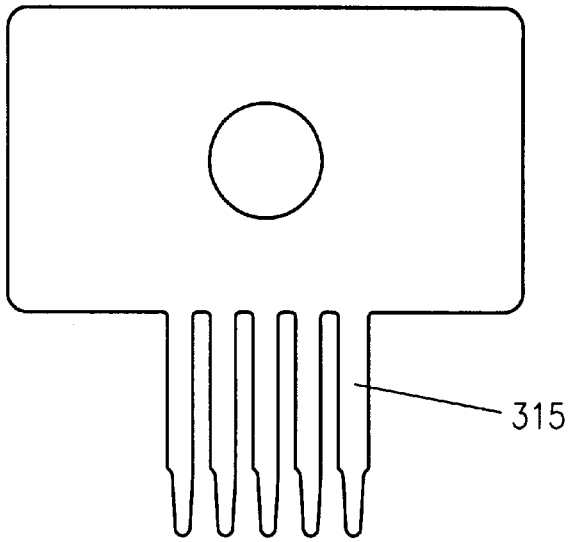
FIG. 24 is a side view of the lower punch of the slitting die set.
Figure 25:
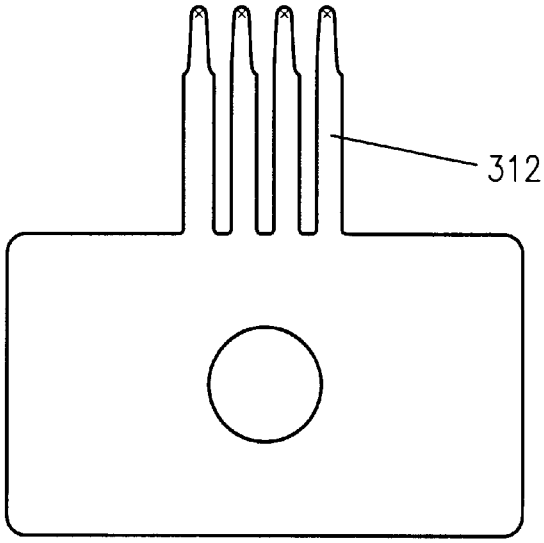
FIG. 25 is a side view of the upper punch of the slitting die set.

FIGS. 24 and 25 provide detail views of the upper and lower punches 312, 315 of the slitting die set.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A device for manufacturing a turbulator from a sheet of material, the device comprising:

at least one preform die having a slot extending from a first end of the die to a second end opposite the first end, the slot formed at the first end of the die by a pair of opposed walls forming an angle there between, the opposed walls being substantially parallel at the second end, the angle between the opposed walls decreasing between the first end and the second end, the at least one preform die adapted to cooperate with a punch to form a die set adapted to form a first rib in the sheet of material as it exits the second end of the die; and, a plurality of progressive die sets having openings and punches adapted for forming a plurality of ribs disposed adjacent to the first rib.

2. The device of claim 1, further comprising:

a roll feeder adapted to feed the sheet of material through the dies.

3. The device of claim 1, further comprising:

a pneumatic feeder adapted to feed the sheet of material through the dies.

4. The device of claim 1, further comprising:

a slitting station adapted to cut and to offset the ribs in the axial direction.

5. A device for manufacturing a turbulator from a sheet of material, the device comprising:

a first preform die having a slot formed by a pair of opposed walls, the opposed walls forming a first angle at a first end and forming a second angle at a second end, the second end of the die disposed opposite from the first end, the first angle being larger than the second angle, the first preform die cooperating with a punch to form a die set adapted to press an initial V-shaped fold in the sheet of material;

a second preform die disposed adjacent to the first preform die and having a slot formed by a pair of opposed walls, the opposed walls forming a first angle at a first end and the opposed walls being substantially parallel at a second end disposed opposite from the first end, the second preform die cooperating with a punch to form a die set adapted to form a first rib in the sheet of material as it exits the second end; and, a plurality of progressive die sets having openings and punches adapted for forming a plurality of ribs disposed adjacent to the first rib.

6. The device of claim 5, further comprising:

a roll feeder adapted to feed the sheet of material through the dies.

7. The device of claim 5, further comprising a press adapted for intermittently stamping the sheet of material as it passes through the dies.

8. The device of claim 5, wherein the first angle on the first preform die is about 110 to 140 degrees.

9. The device of claim 5, wherein the second angle on the first preform die is about 80 to 100 degrees.

10. The device of claim 5, wherein the angle between the opposed walls varies gradually between the first and second ends of the first preform die.

11. The device of claim 5, wherein the first angle on the second preform die is about 70 to 90 degrees.

12. The device of claim 5, wherein the second end of the second preform die comprises a U-shaped slot with substantially parallel side walls adapted to form the first rib.

13. The device of claim 5, wherein the first angle on the first preform die is about 120–130 degrees.

14. The device of claim 5, wherein the second angle on the first preform die is about 85–95 degrees.

15. The device of claim 5, wherein the first angle on the second preform die is about 75–85 degrees.

16. The device of claim 5, further comprising:

a slitting station adapted to cut and offset the ribs in the axial direction.

17. A device for manufacturing a turbulator from a sheet of material, the device comprising:

a first preform die having a slot formed by a pair of opposed walls, the opposed walls forming a first angle at a first end and forming a second angle at a second end, the second end of the die disposed opposite from the first end, the first angle being larger than the second angle, the first preform die cooperating with a punch to form a die set adapted to press an initial V-shaped fold in the sheet of material, the opposed walls being formed from a trapezium surface disposed adjacent to a triangular surface, the trapezium surface terminating along a top surface, the first end of the die being radiused on opposite sides of the slot to form a curved surface, the curved surface radiused from the first end of the die toward the top surface and the trapezium surface;

a second preform die disposed adjacent to the first preform die and having a slot formed by a pair of opposed walls, the opposed walls forming a first angle at a first end and the opposed walls being substantially parallel at a second end disposed opposite from the first end, the second preform die cooperating with a punch to form a die set adapted to form a first rib in the sheet of material as it exits the second end; and, a plurality of progressive die sets having openings and punches adapted for forming a plurality of ribs disposed adjacent to the first rib.

18. The device of claim 17, further comprising:

a slitting station adapted to cut and offset the ribs in the axial direction.

19. A method of manufacturing a turbulator from a sheet of material, comprising:

providing at least one preform die having a slot extending from a first end of the die to a second end opposite the first end, the slot formed at the first end of the die by a pair of opposed walls forming an angle there between, the opposed walls being substantially parallel at the second end, the angle between the opposed walls decreasing between the first end and the second end, the at least one preform die adapted to cooperate with a punch to form a die set adapted to form a first rib in the sheet of material as it exits the second end of the die;

providing a plurality of progressive die sets having openings and punches adapted for forming a plurality of ribs disposed adjacent to the first rib;

feeding the sheet of material through a press containing the at least one preform die and the progressive die sets so that the material is pushed through the dies and is intermittently stamped to form a corrugated strip of material;

slitting and offsetting the corrugated strip of material to form a slit, offset corrugated strip of material; and, cutting the slit, off-set corrugated strip of material into predetermined lengths.

* * * * *